United States Patent [19]

Glover

[11] Patent Number: 4,962,965

[45] Date of Patent: Oct. 16, 1990

[54] SEAT BELT ASSEMBLY FOR HIGH CHAIRS

[75] Inventor: Richard W. Glover, Troy, Ohio

[73] Assignee: Spalding & Evenflo Companies, Inc., Tampa, Fla.

[21] Appl. No.: 409,370

[22] Filed: Sep. 19, 1989

[51] Int. Cl.[5] ..... A47D 15/00

[52] U.S. Cl. ..... 297/467; 24/625; 24/573.5; 297/468

[58] Field of Search ..... 297/464, 467, 468, 250, 297/485; 24/614, 615, 625, 573, 574

[56] References Cited

U.S. PATENT DOCUMENTS

| | | | |
|---|---|---|---|
| 3,052,432 | 9/1962 | Martin | 297/467 |
| 3,694,029 | 9/1972 | Noble et al. | 297/467 |
| 3,713,692 | 1/1973 | McCracken et al. | 297/467 |
| 4,082,349 | 4/1978 | Ballenger | 297/153 X |
| 4,402,548 | 9/1983 | Mason | 297/464 |
| 4,540,218 | 9/1985 | Thomas | 297/467 |
| 4,685,741 | 8/1987 | Tsuge et al. | 297/467 |
| 4,818,016 | 4/1989 | Mariol et al. | 297/153 X |

FOREIGN PATENT DOCUMENTS

| | | | |
|---|---|---|---|
| 2422288 | 11/1974 | Fed. Rep. of Germany | 297/467 |
| 1187677 | 4/1970 | United Kingdom | 297/467 |
| 1374266 | 11/1974 | United Kingdom | 297/467 |

*Primary Examiner*—Peter R. Brown

*Attorney, Agent, or Firm*—Donald R. Bahr

[57] ABSTRACT

An improved high chair comprising a seat with a back component and a bottom component for receiving a child thereon; a plurality of tubes for strengthening the seat and extending on opposite sides of the seat for forming arm rests; a plurality of legs for supporting the seat at a proper height; a tray removably positioned on the arm rests in front of the seat above the bottom component; and a seat belt assembly comprising a pair of generally horizontally extending waist straps each coupled at its remote end to a portion of a high chair seat with a buckle part at its front end, a crotch strap permanently secured to a front central extent of the seat portion and having a free front end, and a main buckle permanently attached to the free end of the crotch strap with the main buckle also having a pair of attachment mechanisms for removably receiving the buckle parts of the ends of the waist straps.

4 Claims, 2 Drawing Sheets

SEAT BELT ASSEMBLY FOR HIGH CHAIRS

BACKGROUND OF THE INVENTION

1. Field of the Invention

This invention relates to a seat belt assembly for high chairs and, more particularly, to a high chair having a seat, legs and a tray and having a seat belt assembly including a fixed crotch strap and a pair of waist straps coupled at a common buckle.

2. Description of the Background Art

A high chair is an item of functional furniture for children which has been in use for many years. A high chair is used to assist a young child in eating and in learning to eat and to help parents feed a child. Normally, a high chair includes a seat for the child. The seat is supported by extended legs. A tray is located in front of the child for his or her food.

A relatively recent advance in high chairs is the incorporation of seat belts to retain the child in proper position on the seat while eating. Seat belts are formed of waist straps secured at their remote ends to the seat, generally to the back or bottom or adjacent their juncture. Seat belts reduce the possibility of a child inadvertently or deliberately sliding down out of the seat, beneath the tray. A more recent advance in high chair seat belts is the incorporation of a crotch strap. A crotch strap normally couples permanently to the central front portion of the seat and extends upwardly for coupling with the waist straps or buckle at a central area. Unfortunately, all known seat belt arrangements are designed so that the waist straps may be used without the crotch strap. This is a shortcoming of prior known devices which causes safety problems for children in high chairs.

Today high chairs represent the third leading cause of accidental deaths for children. Such deaths normally occur when the seat belts are not utilized or seat belts are utilized without a crotch strap. In such situation, a child may slide downwardly, intentionally or inadvertently, and catch his or her chin on the tray. The weight of the body pulling downwardly will cause strangulation resulting in severe injury or death.

The shortcomings of known high chairs and strap arrangements are evidenced by a large number of commercial devices in use today as well as a large number of patents issuing on devices attempting to overcome the deficiencies of the prior art. By way of example, U.S. Pat. No. 4,697,849 to Smith discloses the use of a safety belt arrangement for use with a high chair. In addition, seat belt arrangements are shown in a wide variety of environments other than high chairs. Note U.S. Pat. Nos. 3,709,558 to Jakob; 3,834,758 to Soule; 3,910,634 to Morris; 4,302,049 to Simpson and 4,650,252 to Kassai. Lastly, a large number of patents show a wide variety of buckle arrangements. Note U.S. Pat. Nos. 4,150,464 to Tracy; 4,559,679 to Downey; 4,569,106 to Lovato; 4,662,040 to Terrell; 4,791,709 to Fildan and 4,793,032 to Crowle.

As illustrated by the background art, efforts are continuously being made in an attempt to improve seat belts for high chairs. No prior effort, however, suggests the present inventive combination of component elements arranged and configured as disclosed herein. Prior seat belts for high chairs do not provide the benefits attendant with the present invention. The present invention achieves its purposes, objects and advantages over the prior seat belts for high chairs through a new, useful and unobvious combination of component elements, through the use of a minimum number of functioning parts, and through the use of only readily available materials and conventional components.

It is, therefore, an object of the present invention to provide an improved high chair comprising a seat with a back component and a bottom component for receiving a child thereon; a plurality of tubes for strengthening the seat and extending on opposite sides of the seat for forming arm rests; a plurality of legs for supporting the seat at a proper height; a tray removably positioned on the arm rests in front of the seat above the bottom component; and a seat belt assembly comprising a pair of generally horizontally extending waist straps each coupled at its remote end to a portion of a high chair seat with a buckle part at its front end, a crotch strap permanently secured to a front central extent of the seat portion and having a free front end, and a main buckle permanently attached to the free end of the crotch strap with the main buckle also having a pair of attachment mechanisms for removably receiving the buckle parts of the ends of the waist straps.

It is a further object of the present invention to strap children in high chairs with an arrangement of separable waist straps and a permanent crotch strap to preclude child injury as caused by the child sliding downwardly beneath the high chair tray.

It is a further object of the present invention to permanently attach the ends of a crotch strap to the high chair at one end and to the buckle at the other end.

It is a further object of the invention to increase the safety of high chairs by improved seat belt constructions.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a further understanding of the invention may be had by referring to the summary of the invention and the detailed description of the preferred embodiment in addition to the scope of the invention defined by the claims taken in conjunction with the accompanying drawings.

SUMMARY OF THE INVENTION

The present invention is defined by the appended claims with the specific preferred embodiment shown in the attached drawings. For the purpose of summarizing the invention, the invention may be incorporated into an improved seat belt assembly for use in a high chair comprising a pair of generally horizontally extending waist straps each coupled at its remote end to a portion of a high chair seat and having a buckle part at its front end; a crotch strap permanently secured to a front central portion of the seat and having a free front end; and a main buckle permanently attached to the free end of the crotch strap, the main buckle also having attachment mechanisms for removably receiving the buckle parts at the end of the waist straps.

The main buckle has a slot at its lower extent for the receipt of the free end of the crotch strap and wherein the crotch strap is stitched to itself after passing through and around the slot of the main buckle. The buckle parts at the ends of the waist straps are male members and the main buckle has openings in its upper extent for the receipt of the male members.

In addition, the invention may also be incorporated into an improved high chair comprising a seat with a back component and a bottom component for receiving a child thereon; a plurality of tubes for strengthening the seat and extending on opposite sides of the seat for forming arm rests; a plurality of legs for supporting the seat at a proper height; a tray removably positioned on the arm rests in front of the seat above the bottom component; and a seat belt assembly comprising a pair of generally horizontally extending waist straps each coupled at its remote end to a portion of a high chair seat with a buckle part at its front end, a crotch strap permanently secured to a front central extent of the seat portion and having a free front end, and a main buckle permanently attached to the free end of the crotch strap with the main buckle also having a pair of attachment mechanisms for removably receiving the buckle parts of the ends of the waist straps.

The remote end of the crotch strap is permanently attached to the lower face of the bottom component. The remote ends of the waist straps are coupled to the rear face of the back component. One of the waist straps is attached to its buckle part permanently. Further included is means to adjustably attach the other waist strap to its buckle part.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other constructions for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar reference characters refer to similar parts throughout the several figures.

DETAILED DESCRIPTION OF THE INVENTION

Figure 1:
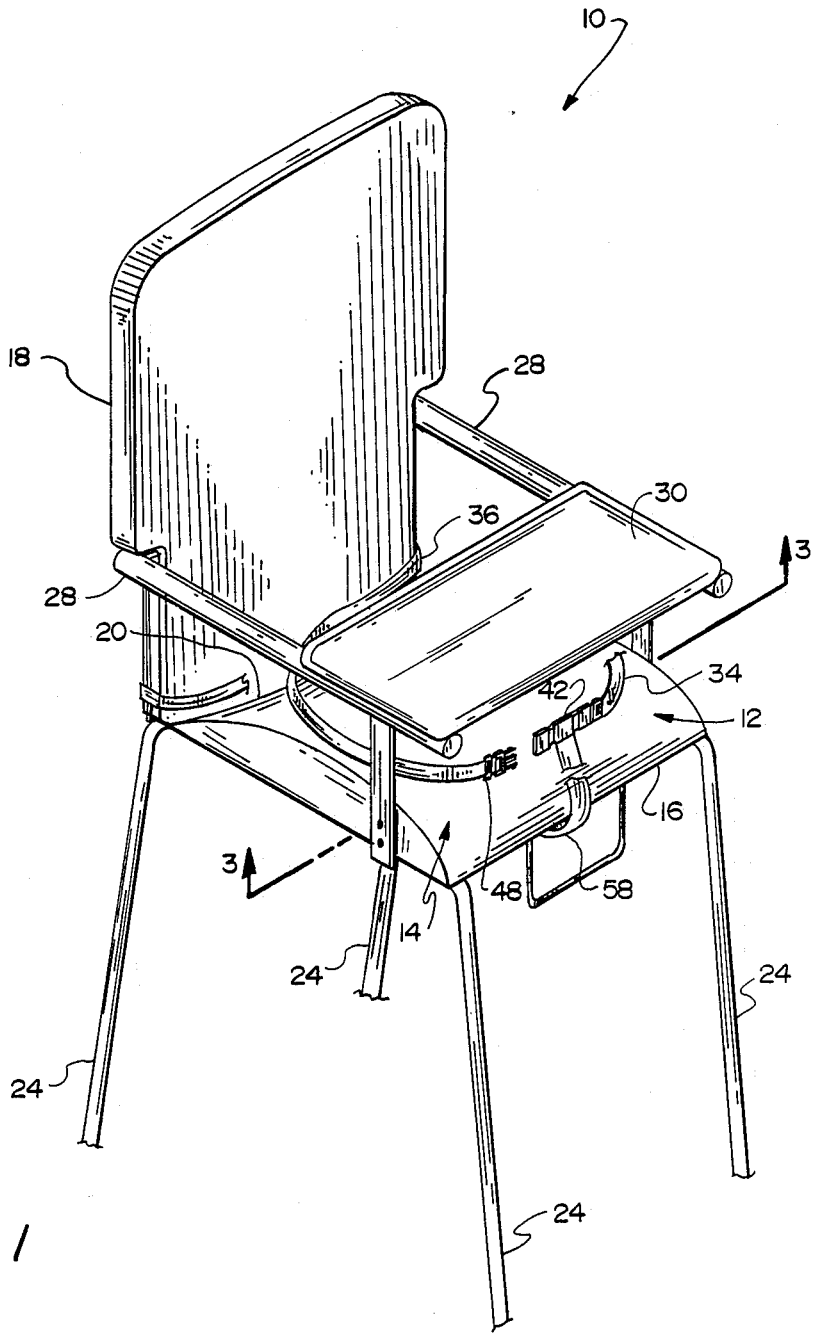
FIG. 1 is a perspective illustration of a high chair employing the seat belt assembly of the present invention.

Shown in FIG. 1 is a high chair 10 with a seat belt assembly 12 constructed in accordance with the present invention. The high chair includes a seat 14 having a bottom component 16 and a back component 18 with appropriate padding for the comfort of the child who will sit therein. The bottom and back components are shown as permanently secured together at a line of junction 20 for maintaining their intended position with respect to each other.

A plurality of legs 24, four in the preferred embodiment, are shown to support the seat 14 at an appropriate height for the convenience of both the child and the parent who may be feeding or otherwise attending to the child. An array of tubes 26 support the seat 14 for increased rigidity and security of the high chair. Such tubes also form arm rests 28 laterally disposed on opposite sides of the seat.

Removably coupled with respect to arm rests 28 of the high chair 10 is a tray 30. The tray 30 is coupled for appropriate removability and adjustability through conventional mechanisms on the lower surface of the tray 30 and the upper surface of the arm rests 28. The tray 30, like the seat 14, is at a convenient height for the child seated in the high chair 10 as well as for the attendant parent.

The seat belt assembly 12 of the present invention includes a pair of waist straps 34 and 36. The waist straps are permanently attached to the rear side of the back component 18 of the seat 14. Permanent coupling of the waist straps 34 and 36 to the high chair 10 is by pinching the remote ends of the waist straps 34 and 36 between the rear side of the back component 18 and the supporting tubes 26 so that the waist straps 34 and 36 may not be removed. This promotes their use for increased child safety.

The forward ends of the straps are coupled to male buckle parts 40 adapted to engage with adjacent female parts of the main buckle 42. In the preferred embodiment, one of the waist straps 34 is stitched 44 to form a permanent coupling with its associated buckle part 40 while the other waist strap 36 is coupled through a slot 46 in the buckle part 40 and has a slotted securement piece 48 for allowing adjustability of the waist strap 36. This is to accommodate children of smaller or larger sizes.

Figure 2:
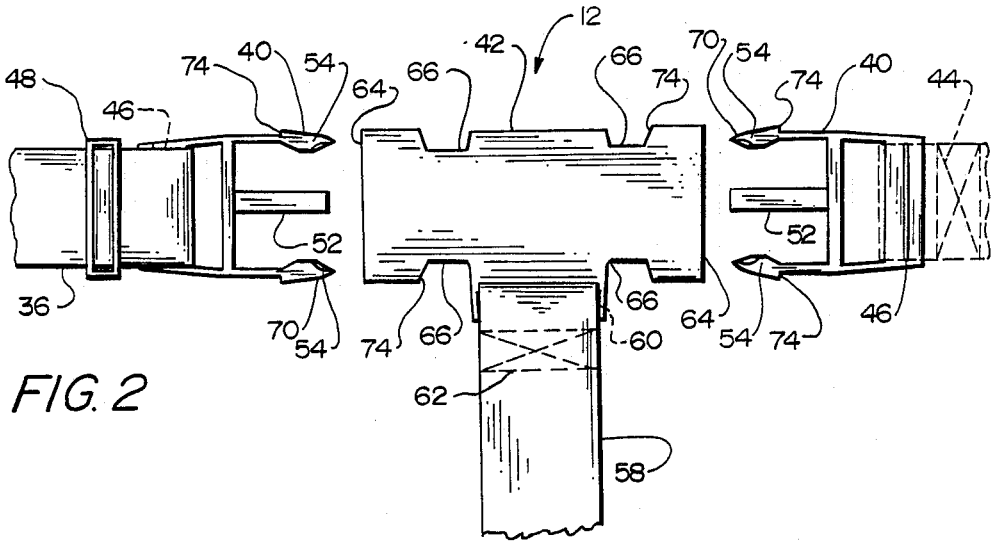
FIG. 2 is an enlarged elevational view of the buckle and straps shown in FIG. 1.
Figure 3:
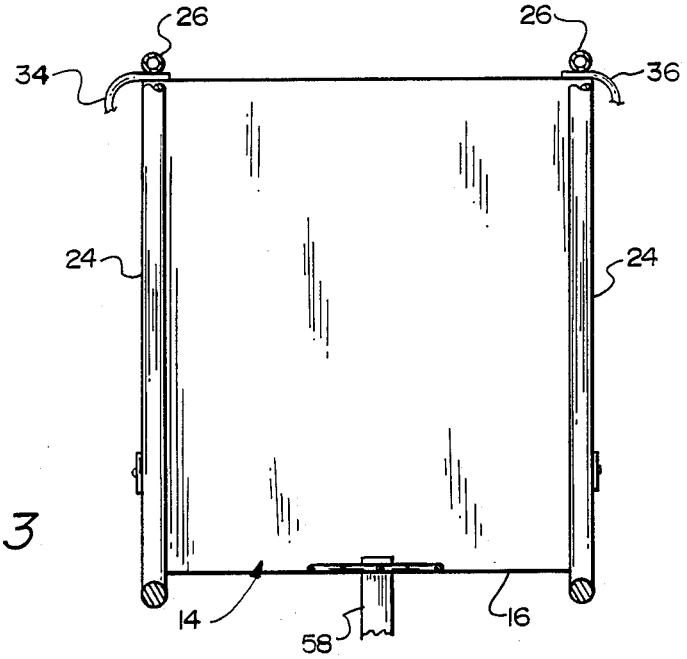
FIG. 3 is an enlarged bottom view of the high chair of FIG. 1 taken along line 3—3 of FIG. 1.

As can be more readily seen in FIG. 2, each male buckle part 40 has a central post 52 extending forwardly for guiding the movement of the male buckle part 40 during the coupling with the main buckle 42. On each side of each central post is a resilient finger 54, movable by an operator, toward the central post 52 coupling and uncoupling with respect to the main buckle 42.

The third strap of the seat belt arrangement is the crotch strap 58 adapted to extend upwardly from the bottom component 16 to the waist straps 34 and 36 between the legs of a child seated in the high chair 10. The crotch strap 58 has its remote end permanently attached to the lower face of the bottom component 16 of the seat 14 through a screw. This effects a permanent attachment therebetween to preclude removal of the crotch strap 58 from the high chair 10. The front end of the crotch strap 58 is attached through a slot 60 in the main buckle 42, folded back on itself, and stitched 62 in position. As such, the main buckle 42 is always in position for use, always attached to the crotch strap 58, and the waist straps 34 and 36 cannot be utilized without the crotch strap since the main buckle 42 is permanently attached to the crotch strap 58.

The main buckle 42 of the present invention is permanently attached to the crotch strap 58 at a slot 60 at its lower extent. The upper extent of the main buckle 42 includes a pair of aligned female openings 64 for receiving the free ends of the male buckle parts 40 attached to the forward ends of the waist straps 34 and 36. The main buckle 42 also has cutouts 66 on each end, top and bottom, adapted to receive the inwardly flexible resilient fingers 54 of the male buckle parts 40 on the waist straps 34 and 36. The male buckle parts also have an enlarged central post 52 for guiding and aligning the entry of the male buckle parts 40 into central aligned openings of the main buckle 42.

When inserted, the resilient fingers 54 of the male buckle parts 40 will cam down towards the central post 52 due to the curvatures 70 at their remote ends. When fully inserted, the resilient fingers 54 will spring back and intermediate shoulders 74 will engage mating shoulders 76 within the cutouts 66 of the main buckle 42 for permanent attachment until the resilient fingers 54 are eventually urged inwardly toward the central post 52 by a user so that they can be then withdrawn from the main buckle 42. Note is taken that the main buckle 42 may not be put in position for receiving the waist straps 34 and 36 unless the crotch strap 58 is located in proper position for child safety.

The straps, waist and crotch, are fabricated of conventional strapping material, inextensible or essentially inextensive, either natural or synthetic, so that they will not stretch over time. This retention of strap length over prolonged use further promotes child safety. Further, the main buckle and male buckle parts are fabricated of a generally rigid material, metal or preferably a toxically safe plastic, again for child safety.

In operation and use a parent or other attending adult will first place the waist straps across the seat at the line of junction 20 so that the waist straps cross each other and overlap. The parent will then place the child in the seat 14 of the high chair 10. The crotch strap 58 will then be brought upwardly between the child's legs full length until the main buckle 42 is at about the child's waist. Then a first waist strap 34 is coupled to the main buckle through the male buckle part 40. The first waist strap effectively follows an S-shape. The same procedure is then followed for the second waist strap 36 and male buckle part 40. The two waist straps effectively form a FIG. 8 encompassing the child and part of the back components 18. The child is then safely positioned in the high chair. To remove the child, the resilient fingers 54 of one male buckle part 40 are squeezed toward each other and the male buckle part 40 is withdrawn from the main buckle 42. This separates one waist strap 34 from the main buckle 42. The other male buckle part 40 is then withdrawn by the same procedure to separate the second waist strap 36. The child may then be removed from the high chair.

The present disclosure includes that contained in the appended claims as well as that of the foregoing description. Although this invention has been described in its preferred form with a certain degree of particularly, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A high chair comprising:

a seat with a back component and a bottom component for receiving a child thereon;

a plurality of tubes for strengthening the seat and extending on opposite sides of the seat for forming arm rests;

a plurality of legs for supporting the seat at a proper height;

a tray removably positioned on the arm rests in front of the seat above the bottom component; and a seat belt assembly comprising a pair of generally horizontally extending waist straps each coupled at its remote end to a portion of a high chair seat with a buckle part at its front end, a crotch strap permanently secured to a front central extent of the seat portion and having a free front end, and a main buckle permanently attached to the free end of the crotch strap with the main buckle also having a pair of attachment mechanisms for removably receiving the buckle parts of the ends of the waist straps and operator controlled means to individually separate each buckle part at the waist strap free end from the main buckle.

2. The high chair as set forth in claim 1 wherein the remote end of the crotch strap is permanently attached to the lower face of the bottom component.

3. The high chair as set forth in claim 2 wherein the remote ends of the waist straps are coupled to the rear face of the back component.

4. The high chair as set forth in claim 3 wherein one of the waist straps is attached to its buckle part permanently and further including means to adjustably attach the other waist strap to its buckle part.

* * * * *